United States Patent [19]

Schimmel

[11] 4,418,884

[45] Dec. 6, 1983

[54] DOUBLE-HINGE CORNER FOR A CONCRETE FORMING STRUCTURE

[75] Inventor: Vernon R. Schimmel, Lincolnwood, Ill.

[73] Assignee: Symons Corporation, Des Plaines, Ill.

[21] Appl. No.: 377,977

[22] Filed: May 13, 1982

[51] Int. Cl.[3] ..... E21D 10/00

[52] U.S. Cl. ..... 249/11; 249/171

[58] Field of Search ..... 249/196, 11, 182, 194, 249/171, 170, 172, 185

[56] References Cited

U.S. PATENT DOCUMENTS

| | | | |
|---|---|---|---|
| 3,357,673 | 12/1967 | Williams | 249/194 |
| 3,696,177 | 10/1972 | Holland | 249/22 X |
| 4,055,321 | 10/1977 | Schimmel | 249/171 |
| 4,210,306 | 7/1980 | Schimmel | 249/196 |

*Primary Examiner*—Donald E. Czaja

*Assistant Examiner*—James C. Housel

*Attorney, Agent, or Firm*—Hill, Van Santen, Steadman & Simpson

[57] ABSTRACT

A concrete forming structure for culverts, tunnels, elevator shafts and the like, having side panels and chamfered corners. Novel two-way hinge assemblies are provided adjacent the chamfered corners and comprise two hinges and an angle iron disposed therebetween. The hinges are attached to confronting marginal faces of side panel sections and corner panel sections. Means are provided for holding the panel sections in a predetermined position to facilitate the pouring of the concrete and with the means being releasable. The panel sections and hinges are cooperable to allow the panel section to collapse and move after release of the means for allowing the panel section to be readily disengaged from the thus formed poured concrete. The hinges are lockable in a forming configuration.

18 Claims, 7 Drawing Figures

DOUBLE-HINGE CORNER FOR A CONCRETE FORMING STRUCTURE

BACKGROUND OF THE INVENTION

1. Field of the Invention

The present invention relates generally to concrete forms and has particular reference to new and improved articulated collapsible forms which are adapted for use in the formation of concrete structures such as a concrete culvert, a tunnel, or an elevator shaft. When the forms are used to provide a rectangular outline of an inside wall surface of a horizontally or vertically disposed corewall having chamfered corners, the corewall can be formed by pouring wet concrete around the form. With the unique double-hinge or two-way hinge construction that is provided in the types of forms herein disclosed, the forms can be collapsed inwardly away from the form walls so that the form is loosened from the hardened corewall-forming concrete and may then be shifted away from the formed wall into a position for use in connection with a subsequent concrete pour.

Concrete corewalls of the character under consideration are commonly employed in a horizontal position in connection with the creation of culverts, tunnels, or similar structures, or in a vertical position for elevator shafts, stairwells and the like.

2. The Prior Art

Heretofore, it has been the practice, when constructing an articulated collapsible concrete form for the inside surfaces of a rectangular corewall, to utilize a hinge joint at the midpoint of each of the two long sides of the rectangular form so that when the joints are broken inwardly, the articulated form collapses to produce a smaller form structure which has the outline of two truncated triangles which are connected in tandem fashion with their truncated corners joined together. The overall outline of such a collapsed form structure being smaller than the outline of the expanded form structure enables the collapsed structure to clear the walls of the hardened concrete of the corewall so that the collapsed form structure may be shifted longitudinally along the corewall to a new position for a subsequent concrete core or for removal purposes. Other types of collapsible concrete forms that have been used before are also shown in my U.S. Pat. No. 4,055,321, wherein three-way hinge assemblies are disclosed.

An articulated collapsible inside form structure of the character set forth above has certain limitations and an important object of this invention is to provide a new and improved two-way hinge assembly that can be used in a number of different types of forms for forming a variety of concrete wall structures having chamfered corners.

SUMMARY OF THE INVENTION

According to important features of this invention, there is provided an inside articulated and collapsible concrete form for forming a concrete wall structure having chamfered concrete corners, the form having spaced panel sections and a chamfered corner positioned between said spaced panel sections, said panel sections and said corner having forming faces and marginal frame edges, and means for releasably positioning and holding said panel section and said corner in predetermined positions to facilitate the pouring of concrete, and a pair of double hinge corner assemblies with one secured at each end of said chamfered corner, and the double hinge corner assembly also being secured to an associated one of said panel sections, and said double hinge corner assembly each comprising first and second hinges in spaced parallel relation; whereby said panel sections are pivotal on said hinge assembly to effect disengagement of said panel sections from the poured concrete, the hinges being cooperable with said hinge leaves, with said means connecting said hinges and with the panel sections to collapse and move after release of said means for releasably holding said panel section.

According to other features of this invention, there is provided a new and improved two-way hinge structure for use in combination with a variety of different types of concrete forms including a form for forming corewalls and a form for forming concrete wall structures such as ones having intersecting walls with chamfered inside wall corners.

Other features of this invention relate to a new and improved two-way hinge structure that includes two hinges which are positioned in spaced relation to one another, and where a swinging angle is disposed between the hinges.

Yet another important feature of this invention concerns a new and improved two-way hinge structure for a concrete form where a swinging angle is welded to outside faces of hinge plates of adjacent hinges, and with the angle having an angle leg positioned in confronting relation to the end face of a first panel section, and fastener means being provided to join the angle leg in confronting assembly with the end face of the panel section, and fastener means being provided to join a hinge plate to the end face of a second panel section. A still further feature of this invention is to provide a new and improved two-way hinge structure in combination with a corewall form which is characterized by the hinge structure being positionable relative to adjacent panel sections for forming chamfered upper corners of a poured-in-place concrete tunnel, shaft or the like.

According to an alternate embodiment of the invention, a double-hinge is provided having a series of three hinge plates joined along adjacent edges by two hinges. The two end hinge plates are attachable to the confronting marginal faces of a wall panel section and a corner panel section of a chamfered corner. A swinging angle iron is attached to inner surface of the intermediate hinge plate with its heel near a hinge.

According to an important feature of the invention, means are provided for locking the double-hinge structure in its expanded state. Wedge bolts can be inserted through co-aligned slots in the wall panel marginal frame, in an end hinge plate and in the angle iron. Additional wedge bolts inserted crosswise through holes in the first wedge bolts prevent the double-hinge structure from moving to a collapsed state.

An important object of this invention is to provide an improved two-way hinge assembly for releasing corewall forms.

Another important object of this invention is to provide a new and improved two-way hinge assembly in combination with an appropriate concrete form structure which is operable to release core forms after wet concrete has hardened to form tunnels, shafts and the like and which may be relocated and expanded into position for a subsequent pour of concrete without the necessity of disassembling the components of the concrete form at resultant great savings in labor, time and money.

Still another important object of this invention is to provide a new and improved two-way hinge assembly in combination with an appropriate concrete form structure which is operable to release chamfer cornered ganged tunnel or shaft forms without the necessity of disassembly of the concrete form.

Still another object of this invention is to provide a two-way hinge assembly and concrete form combination which is designed to generate dimensional stripping relief for ganged tunnel or shaft forms that contain chamfered corners, and likewise ganged vertical corewall forms that include chamfered corners and where the two-way hinge can be used to form an obtuse angle corner.

An important object of this invention is to provide a new and improved two-way hinge assembly for use with a concrete form that foreshortens the concrete contact dimension of ganged forms after the concrete is placed and which may be locked in an expanded state.

The provision of an inside articulated and collapsible concrete form for use in a corewall form and a tunnel wall form has now been briefly outlined above and which possesses the stated advantages and which constitutes the principal object of the present invention.

Numerous other objects and advantages of the invention, not at this time enumerated, will readily suggest themselves as the following description ensues.

The invention consists in the several novel features which are hereinafter set forth and are more particularly defined by the claims at the conclusion hereof.

In the accompanying three sheets of drawings forming a part of this specification, two illustrative embodiments of the invention are shown.

DESCRIPTION OF THE PREFERRED EMBODIMENTS

Figure 1:
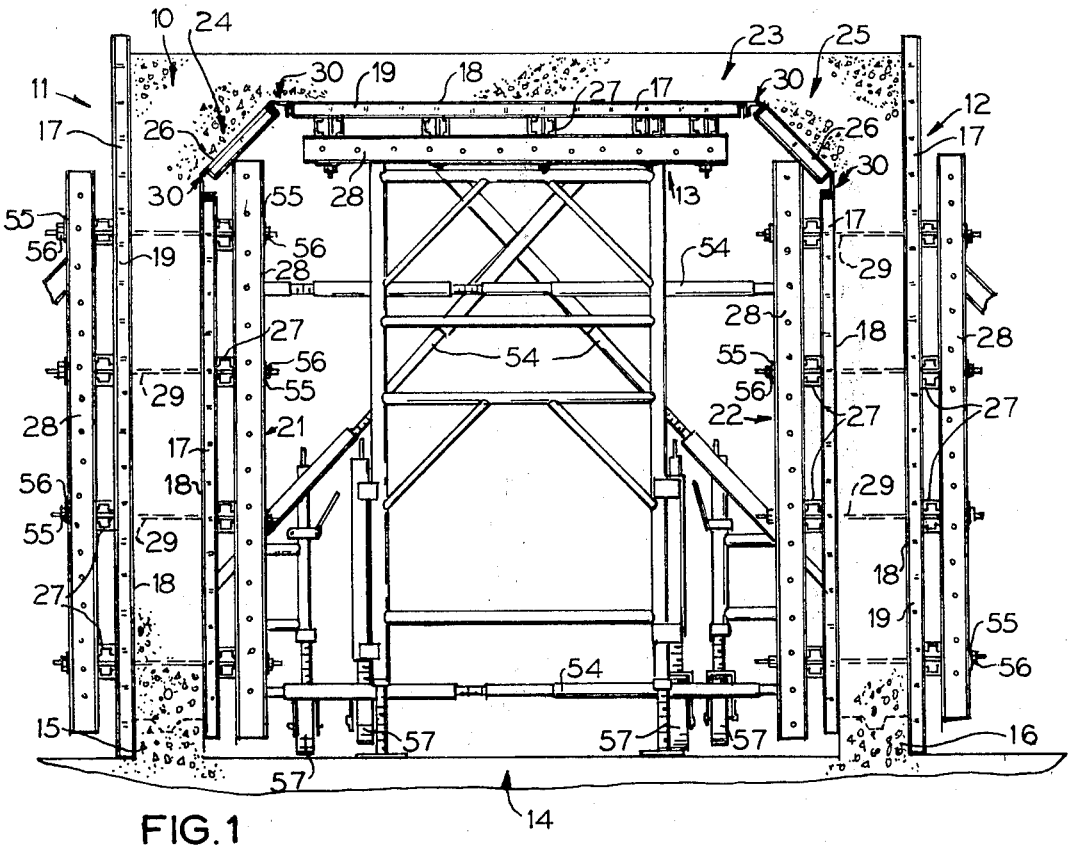
FIG. 1 is an enlarged fragmentary end view of the tunnel forming form structure in position with respect to spaced forms for forming a tunnel or culvert and illustrating the new and improved two-way hinge assemblies of the present invention.
Figure 3:
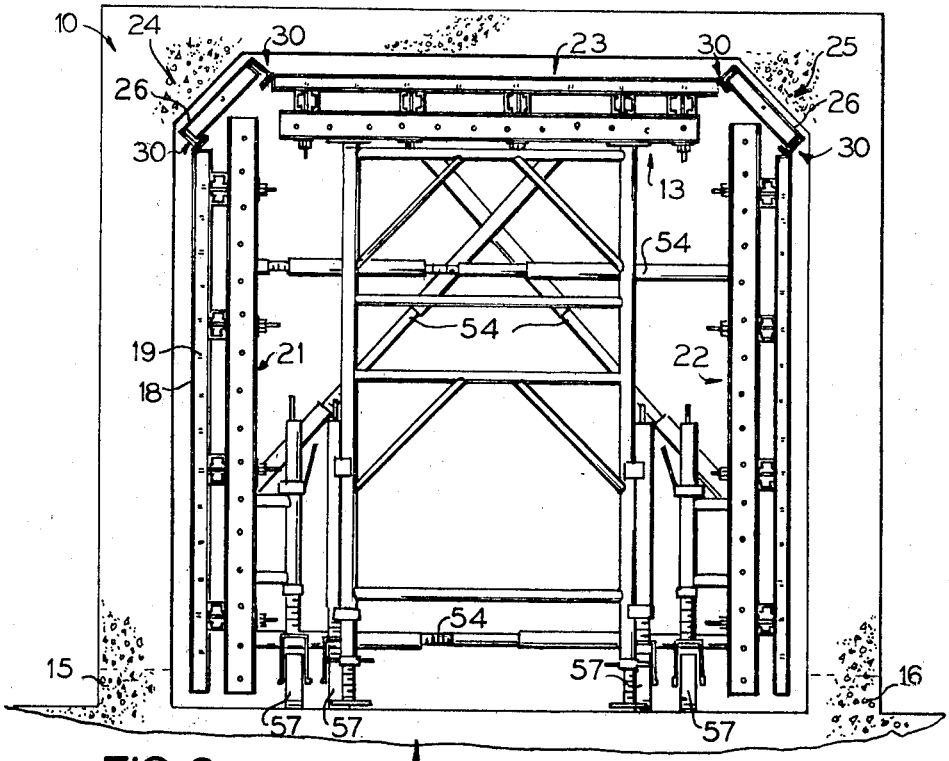
FIG. 3 is an enlarged fragmentary view similar to FIG. 1 but showing the tunnel or culvert formed in combination with the two-way hinge assembly in a stripped away position relative to the formed concrete tunnel.

Referring now to the drawings in detail and in particular to FIGS. 1 and 3, there is disclosed in these views a generally rectangular horizontally disposed concrete corewall 10 which, for purposes of discussion herein, may be regarded as being a tunnel or culvert which is under construction and is formed for the most part of concrete. The present invention is concerned with construction of such a tunnel-like corewall and this is accomplished in the usual manner by pouring wet concrete between and above outside forms such as illustrated forms 11 and 12, and inside form 13, and a previously constructed floor 14 having starter wall portions 15 and 16.

The outside concrete corewall forms 11 and 12 are of conventional construction and are comprised of a series of laterally ganged panel sections or units 17, the number of units in each gang depending, of course, upon the dimensions of the corewall 10.

The particular panel units or sections 17 which are employed for the inside and outside corewall forms 11, 12 and 13 may vary widely, but for purposes of illustration herein, panel units of the "Steel-Ply" type have been selected for exemplary illustration herein. This panelling unit which has been found admirably well-adapted for use in connection with the present invention is a panel which is known as a "Steel-Ply" panel. Such a panel is manufactured and sold by Symons Corporation. A typical "Steel-Ply" panel unit is shown and described in U.S. Pat. No. 3,357,673, granted on Dec. 12, 1967, entitled "Concrete Wall Form With a Particular Panel Hinge Arrangement". As shown throughout the drawings, each of the various panelling units 17 regardless of whether they be associated with the inside concrete corewall form 13 or the outside forms 11 and 12, includes a multi-ply plywood facing 18 and a marginal steel frame 19.

The inside concrete form 13 is of novel construction and it is essentially an articulated form which is collapsible as will be pointed out in detail hereafter and comprises left and right form sides 21 and 22, top side 23, and rigid right-angled chamfered corners 24 and 25. The chamfered regions of the corners 24 and 25 comprise panels or panel units or sections of the same construction previously described. Corner panel units 26 are connected to the adjacent top and side panel units 17 by novel two-way steel hinge assemblies or structures 30. The assemblies or structures 30 are also identified herein as haunch hinges.

Reinforcing means for the outside and inside forms 11, 12 and 13 is provided comprising horizontal C-shaped walers 27 which are secured to the panel units 17 by means of suitable fasteners in a conventional manner and strongback structures 28 mounted in abutment against the walers 27. The strongback structures 28 are held in place by wall ties 29 which serve to hold the inside and outside forms in a predetermined position and more particularly to affix the position of the form panel units 17 in place. The wall ties 29 are of a conventional construction.

Figure 2:
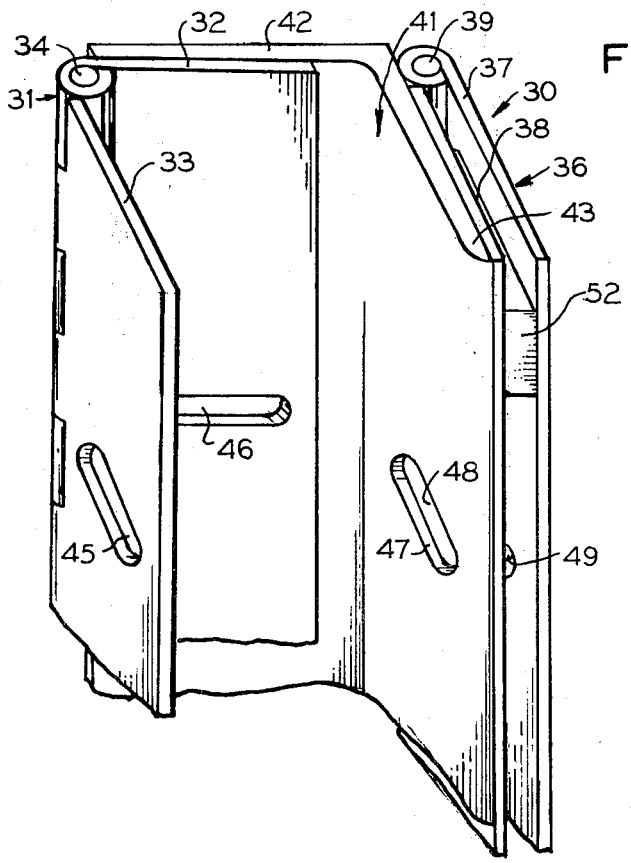
FIG. 2 is an enlarged fragmentary perspective view of one of the two-way hinge assemblies shown in the preceeding figure.
Figure 4:
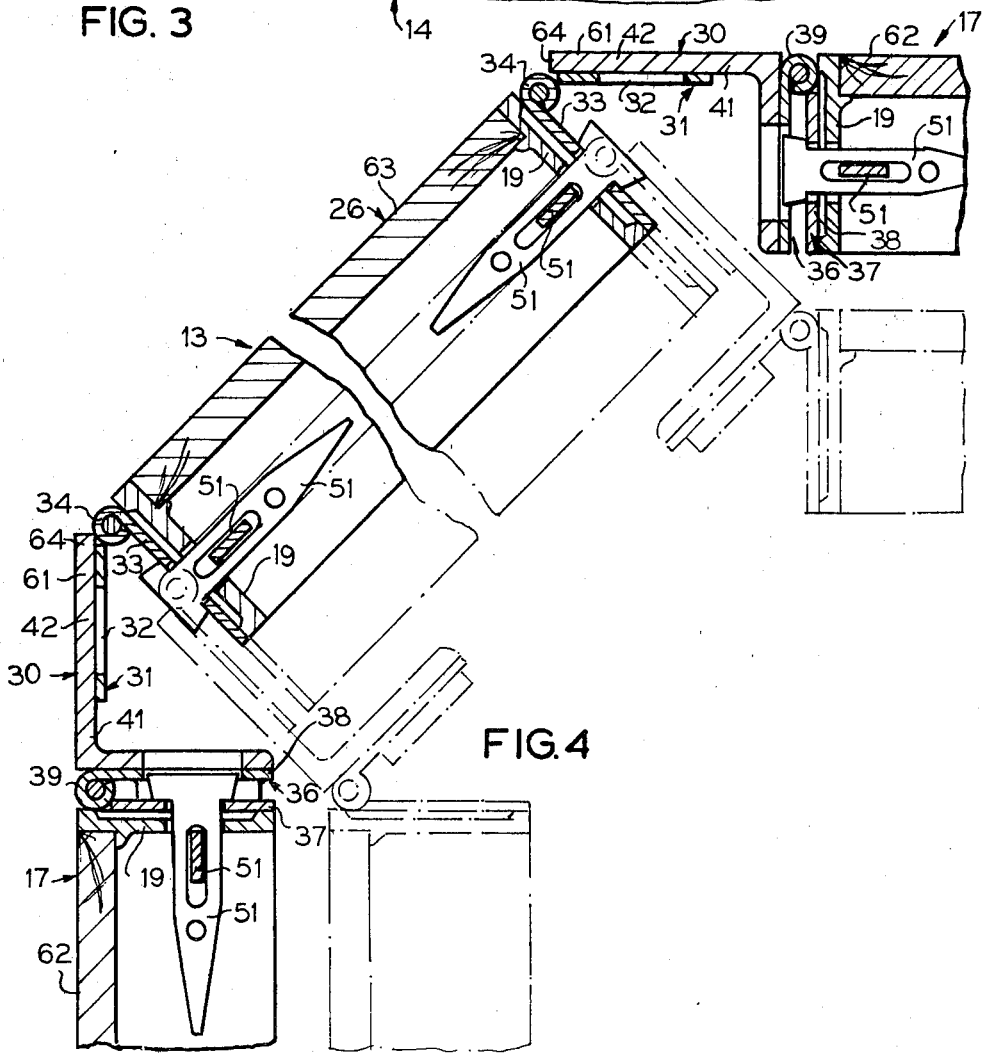
FIG. 4 is an enlarged fragmentary perspective view illustrated in full and broken lines showing how the hinge assembly of FIG. 2 can be collapsed away from a formed concrete tunnel or shaft.

Referring now additionally to FIG. 2 of the drawings, each of the two-way hinge assemblies 30 is preferably formed of stainless steel and involves in its general organization a first hinge structure 31 comprising elongated hinge leaves or plates or plate legs 32 and 33 which are connected together at their proximate side edges by a piano-type hinge 34, and a second hinge structure 36 similarly comprising hinge leaves 37 and 38 and piano-type hinge 39. The hinge leaves 32 and 38 are swinging leaves and the leaves 33 and 37 are attachment leaves designed for attachment to the margin of an adjacent panel 24 (as shown in FIG. 4). An L-shaped member such as a steel angle 41 having angle legs 42 and 43 is interposed between the hinge structures 31 and 36. Angle leg 42 is welded to hinge leaf 32 with the inner surface of angle leg 42 is welded to hinge leaf 32 with the inner surface of angle leg 42 overlying the outer surface of hinge leaf 32. Angle leg 43 is welded to hinge leaf 38 with the outer surface of hinge leaf 38 overlying the outer surface of angle leg 43. Angle leg 43 and hinge leaves 32, 33, 37 and 38 each have bolts slots 45, 47, 48 and 49 and conventional wedge bolts 51 (FIG. 4) are engageable therethrough for fastening them to adjacent structures in different arrangements as shown throughout the figures. A clearance slot 46 is provided in hinge leaf 32 to receive and avoid interference with the head of the wedge bolt in slot 45 when the hinge assembly is in a collapsed state (FIG. 4).

In FIGS. 1, 3 and 4, the hinge leaves 36 are secured to the adjacent panels 17 and the hinge leaves 33 are secured to the corner panel units 26 through the slots 45 and 48 by the wedge bolts 51 in a conventional manner. Suitable wedge bolt are described in U.S. Pat. No. 4,210,306, issued June 1, 1980. In FIG. 4, it can be seen there how the wedge bolts 51 can be engaged together to fasten components together in a manner well known in this art.

In order to cause the inside corewall form to collapse, it will be seen that the form is articulated and collapsible. Before the inside articulated and collapsible concrete form 13 can be collapsed, the wall ties 29 must be disconnected by removing the tie bearing plate 55 and the fasteners 56 securing these components in assembly. The collapsed position of the rectangular inside form 13 is shown in FIG. 3, where it will be observed that the wall ties 61 have been removed. Once the inside form 13 has been collapsed, wheel assemblies 57 contact the floor 14 allowing the inside form 13 to be rolled to a new position where the collapsed tunnel form 13 can be expanded using the turnbuckles 54 to cause the form sides 21 and 22 and the top side 23 to be moved into the position illustrated in FIG. 1 in readiness for a subsequent pour of concrete.

In FIG. 4, the collapsing action of the invention is shown in greater detail. The forming structure is shown in its expanded state (corresponding to FIG. 1) in full lines and in its collapsed state (corresponding to FIG. 3) in phantom lines.

Hinge leaves 33 and 37 are secured in parallel arrangement to the marginal frames 19, corner panel units 26, and top and side panel units 17, respectively, by means of wedge bolts 51. To minimize discontinuities in the finished concrete surface, the hinge assemblies 30 are constructed so that in their expanded state the outer surfaces 61 of angle legs 42 are coplanar with the outer surfaces 62 of panel unit 17 and the piano hinge portion 39 is tangent to the plane determined thereby. Furthermore, it is preferable that the piano hinge portions 34 lie tangent to the plane determined by the outer surface 63 of the corner panel units 26 and that the corners 64 of the angle irons 41 lie in the same plane.

When collapsing action is initiated, as described above, hinge leaves 32 and 33 of hinges 31 converge while simultaneously hinge leaves 37 and 38 of hinges 36 diverge. Angle irons 41 swing inward toward the corner panel unit 26 with the net result being that the inside form has contracted to the position represented in phantom lines. It may be seen that there is now clearance between the inside form 13 and the corewall enabling relocation of the inside form 13.

Figure 5:
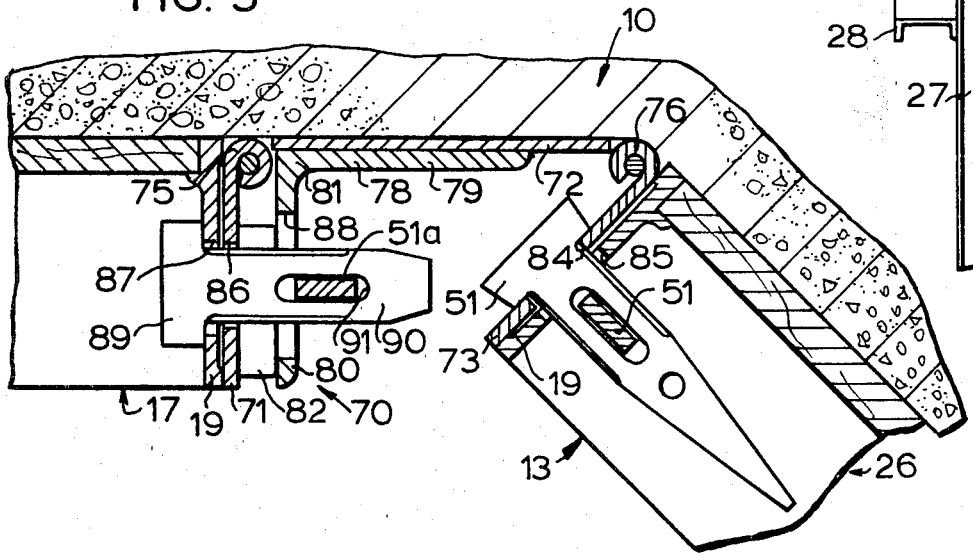
FIG. 5 is a fragmentary sectional view of an alternative embodiment of the two-way hinge assembly of the invention as used in a concrete forming structure and held in an expanded state by the locking means of the invention.

Referring to FIG. 5, an alternate embodiment of the twoway hinge assembly 70 of the invention is shown attached to a top panel unit 17 and an adjacent corner panel unit 26 as used in forming a corewall 10, in an arrangement such as shown in FIG. 1. Furthermore, FIG. 5 shows a novel means for locking a hinge assembly in an expanded state.

According to this embodiment of the hinge assembly 70, three hinge leaves 71, 72 and 73 are joined in a series along their adjacent edges by piano-type hinges 75 and 76. An L-shaped bar such as an angle iron 78 having legs 79 and 80 is located with one leg 79 fixed to the inner surface of the intermediate hinge leaf 72 and with its heal 81 near the piano hinge 75. A spacer bar 82 is fixed to the inner surface of end hinge leaf 71 and acts to limit the swing of angle leg 80.

End hinge leaf 73 is secured to the marginal frame 19 of the corner panel unit 26 by means of wedge bolts 51 inserted through co-aligned slots 84 and 85 formed in end hinge leaf 73 and marginal frame 19 respectively in the same manner shown in FIG. 4. Although not shown in FIG. 5, end hinge leaf 71 is secured to the marginal frame 19 of the wall panel unit 17 by wedge bolts inserted through co-aligned slots 86 and 87 formed in end hinge leaf 71 and marginal frame 19, respectively, in a manner identical to that shown in FIG. 4 for attachment of hinge leaves 37. Clearance slot 88 is formed in the leg 80 of angle iron 78 to accommodate a wedge bolt head.

This embodiment of the hinge assembly 70 is constructed so that the outer surfaces of the wall panel unit 17 and of intermediate hinge leaf 72 lie in the same plane when the hinge assembly as in its expanded state. Also, the plane of the outer surface of corner panel unit 26 is tangent to the outer arcuate surface of piano hinge 76.

FIG. 5 also illustrates the hinge locking means of the invention. According to this feature, a plurality of co-aligned slots 86, 87 and 88 are provided at spaced intervals along the length of the hinge assembly 70. A sufficient number of slot groups is provided such that not all the slot groups are required for a sufficiently strong attachment of the hinge assembly 70 to the adjacent panel unit. For example, a suitable arrangement is slot groups at 6 inch (152 mm) intervals with wedge bolts inserted in the manner shown in FIG. 4 at 12 inch (305 mm) intervals.

The remaining slot groups may be used for locking (FIG. 5) by the insertion of one or more short nose connecting bolts 89 in the opposite direction of the attachment wedge bolts. Connecting bolt 89 is similar to the wedge bolts 51 but has a foreshortened end portion 90 to avoid interference with other parts of the hinge assembly 70 and the inside form 13. Wedge bolts **51*a* inserted transversely through slots 91 in connecting bolts 89 cooperate therewith to lock the hinge assembly in its expanded state. To collapse the form, wedge bolts 51*a* and connecting bolts 89** are removed.

Figure 6:
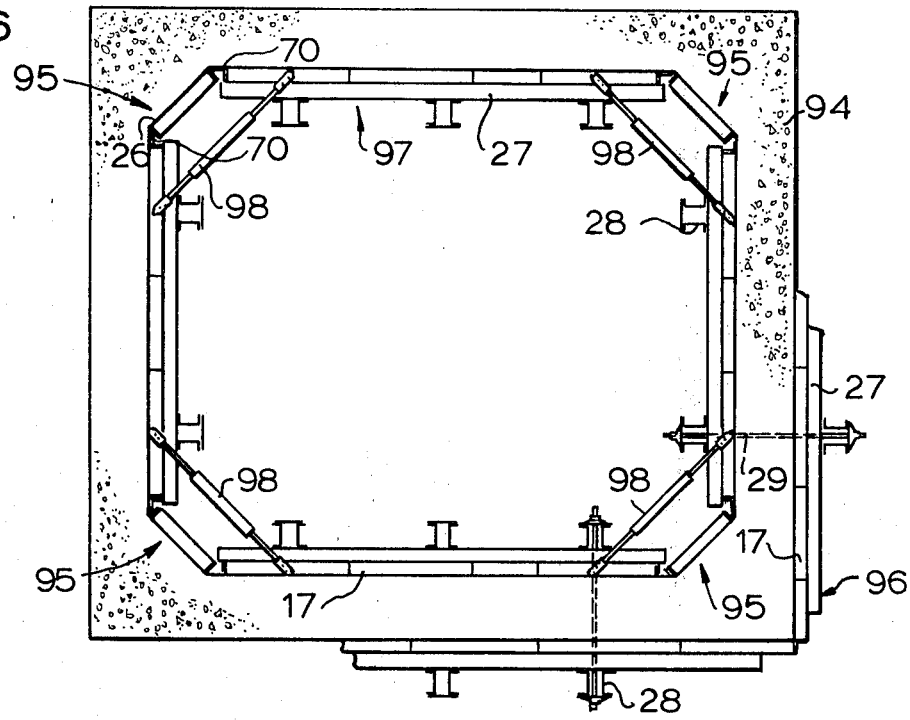
FIG. 6 is a plan view of a forming structure in a vertically oriented corewall having the two-way hinge assemblies as shown in FIG. 5.
Figure 7:
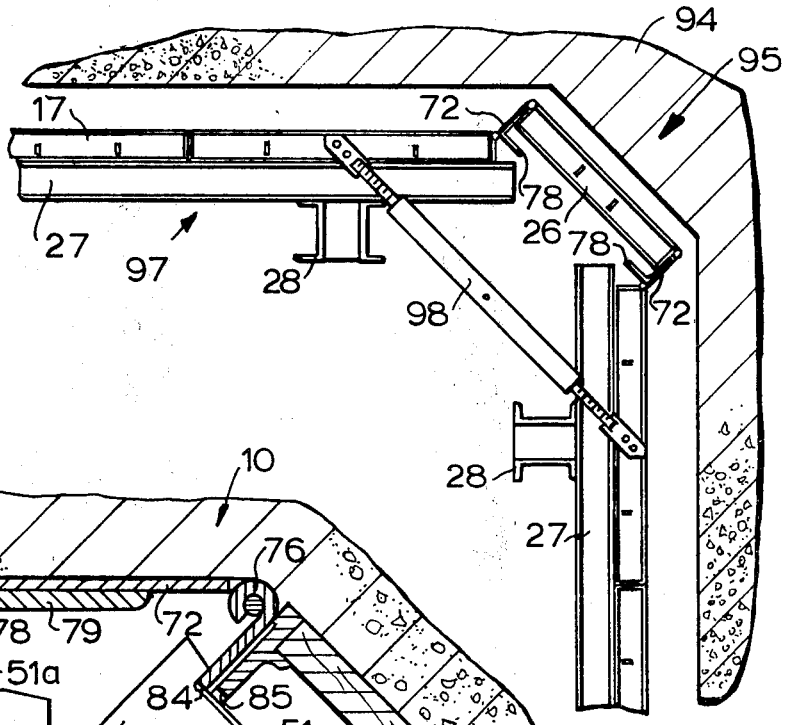
FIG. 7 is an enlarged fragmentary plan view of a corner of the corewall shown in FIG. 6 with the forming structure and hinge assemblies in a collapsed state.

FIGS. 6 and 7 illustrate the use of the alternate embodiment of the hinge assembly 70 as used in another concrete forming structure. This arrangement is particularly suited for use, by way of example, in a vertically oriented corewall 94 such as an elevator shaft having a generally rectangular outline with chamfered corners 95.

The components of the outer form 96 and inner form 97 are substantially the same as shown in FIG. 1 and comprise ganged panel units 17, corner panel units 26, walers 27, strongbacks 28, wall ties 29, and hinge assemblies 70. As an alternate means of holding the shape of the inner form 97, and for inducing collapsing and expanding action, turnbuckles 98 are provided diagonally spanning adjacent wall positions near each corner.

When the inner form 97 is ready to be removed or relocated, turnbuckles 98 are contracted, pulling the form inwardly from the corewall 94. As shown in FIG. 7, this collapsing action causes the intermediate hinge plates 72 and the angle irons 78 to swing inwards toward the corner panel units 26. As a net result, the inner form 97 is withdrawn from the corewall 94 and may be moved without further disassembly.

Either embodiment 30 or 70 of the hinge assembly may be used interchangeably for forming a vertical, horizontal or inclined corewall. The locking means of the invention may be used with either embodiment 30 or 70.

The forming structure of the invention may be used to form a corewall where the outer limits of the corewall are defined partially or completely by soil or rock. In such a case an outer form and wall ties would not be used and bracing devices would be used to stabilize the inner form.

Stripping relief functions of the two-way hinge structure 30 or 70 be utilized in ganged form or hand set forming applications.

Any modular type panel unit 17 is preferably used in combination with the two-way filler hinge structure 30 or 70. A number of other types of panel units can be used including the "Versiform" type. A "Versiform" panel is a steel-clad panel consisting of a rectangular plywood facing which is bonded by a rectangular marginal steel frame. Such panels are manufactured and sold by Symons Corporation of Des Plaines, Ill., and for a full understanding of the nature of a "Versiform panel", reference may be had to a brochure which was published in 1974 by Symons Corporation and is entitled "Vertical Forming Systems".

It will be understood that variations and modifications may be effected without departing from the spirit and scope of the novel concepts of this invention.

I claim as my invention:

1. An inside articulated and collapsible concrete form for forming a concrete wall structure having chamfered concrete corners, the form having spaced panel sections and a chamfered corner positioned between said spaced panel sections, said panel sections and said corner having forming faces and marginal frame edges, and means for releasably positioning and holding said panel section and said corner in predetermined positions to facilitate the pouring of concrete, and a pair of double hinge corner assemblies with one secured at each end of said chamfered corner, and the double hinge corner assembly also being secured to an associated one of said panel sections, and said double hinge corner assembly each comprising:

first and second hinges in spaced parallel relation;

means hingeably connecting said first and second hinges and having an L-shaped member carried thereon longitudinally parallel with said first and second hinges for releasably positioning said connecting means substantially coplanar with said forming face of said wall panel section;

a first hinge leaf hingeably connected to said first hinge;

a second hinge leaf hingeably connected to said second hinge;

means for operatively connecting said first hinge leaf to a marginal frame edge of said wall panel section in confronting relation; and means for operatively connecting said second hinge leaf to a marginal frame edge of said corner panel section in confronting relation;

whereby each panel section is pivotal on its associated double hinge corner assembly and movable inwardly relative to said chamfered corner to effect disengagement of said panel sections from the poured concrete, the hinges being cooperable with said hinge leaves, with said means connecting said hinges and with the panel sections to collapse and move after release of said means for releasably holding said panel sections.

2. A concrete form according to claim 1, wherein said means for connecting said first and second hinges comprises a third hinge leaf hingeably attached to said first hinge, a fourth hinge leaf hingeably attached to said second hinge leaf, the outer surface of said third hinge leaf being confrontingly fixed to the outer surface of a first leg of said L-shaped member and the outer surface of said fourth hinge leaf being confrontingly fixed to the inner surface of a second leg of said L-shaped member.

3. A concrete form according to claim 2, further comprising means for locking said hinge assembly in a forming configuration, said means comprising co-aligned holes formed in a marginal frame edge of said wall panel section, in said first and third hinge leaves and in said first angle leg, and connector means inserted through said co-aligned holes whereby pivotal action of said first hinge is locked out.

4. A concrete form according to claim 1, wherein said means for hingeably connecting said first and second hinges comprises a third hinge leaf intermediate said first and second hinges and said L-shaped member has a first leg confrontingly affixed to the inner surface of said third hinge leaf, a heel near said first hinge, and a second leg extending inwardly from said third hinge leaf.

5. A concrete form according to claim 4, further comprising means for locking said hinge assembly in a forming configuration, said means comprising co-aligned holes formed in the marginal frame edge of said wall panel section, in said first hinge leaf and in said second leg, and connector means inserted through said co-aligned holes, whereby pivotal action of said first hinge is locked out.

6. The concrete of claim 1, further characterized by said concrete forming structure having a plurality of chamfered corners and panel sections for forming a poured-in-place concrete corewall.

7. The concrete form of claim 1, further characterized as including a plurality of said panel sections and said chamfered corners and being arranged to act as a core form and with said panel sections being collapsible on said hinges provided by said hinge assemblies inside a poured and formed concrete corewall formed about said core form for rapid removal of said form.

8. The concrete form of claim 1, wherein said means for positioning said panel sections in predetermined position comprises one or more releasable turnbuckles.

9. The concrete form of claim 1, further characterized by said means for holding said panel sections in predetermined positions comprising at least one wall tie for fixing the position of the form panel sections.

10. The concrete of claim 1, further characterized as including an inside articulated and collapsible concrete form for forming a tunnel, a culvert or the like, said form comprising three form sides, the sides being joined at the corners and with the corners being chamfered and said hinge assemblies being positioned in adjacency to each chamfered corner.

11. The concrete form of claim 1, further characterized as including an inside articulated and collapsible form for forming an elevator shaft, a stairwell or the like, said form comprising four form sides, the sides being joined at the corners and with the corners being chamfered and said hinge assemblies being positioned in adjacency to each chamfered corner.

12. An inside articulated and collapsible concrete form for forming a concrete wall structure having chamfered concrete corners, the form having spaced panel sections and a chamfered corner positioned between said spaced panel sections, said panel sections and said corner having forming faces and marginal frame edges, and means for releasably positioning and holding said panel section and said corner in predetermined positions to facilitate the pouring of concrete, and a pair of double hinge corner assemblies with one secured at each end of said chamfered corner, and the double hinge corner assembly also being secured to an associated one of said panel sections, and said double hinge corner assembly each comprising:

first and second hinges in spaced parallel relation;

means hingeably connecting said first and second hinges and having a L-shaped member carried thereon, parallel with said first and second hinges, having a first leg disposed between said hinges, a heel near said first hinge and a second leg inwardly and perpendicularly disposed to said first leg, said second leg having spaced slots formed therein coalignable with said slots in said marginal frame;

a first hinge leaf hingeably attached to said first hinge having spaced slots therein co-aligned with said slots in said second leg;

a second hinge leaf hingeably attached to said second hinge;

means for confrontingly attaching said first and second hinge leaves to adjacent confronting faces of said marginal frames of adjacent forming panels;

whereby said forming panel sections are pivotal on said hinge assembly to effect disengagement of said panel sections from the poured concrete and whereby connector means may be inserted through said co-aligned slots and in said marginal frame, first hinge leaf and second leg thereby locking out pivotal action of said first hinge and maintaining said concrete form in a forming configuration.

13. A collapsible concrete form according to claim 12, wherein said connector means comprises a connecting bolt inserted through said slots and a wedge bolt inserted transversely through said connecting bolt.

14. A collapsible concrete form according to claim 12, further comprising spacer bar means between said first hinge leaf and said second leg for maintaining said means hingeably connecting said first and second hinges substantially coplanar with the forming face of said panel section adjacent said first hinge.

15. An inside articulated and collapsible concrete form for forming a concrete wall structure having chamfered concrete corners, the form having spaced panel sections and a chamfered corner positioned in inclined relation between said spaced panel sections, and panel sections and said corner having forming faces and marginal frame edges, and means for releasably positioning and holding said panel sections and said corner in predetermined positions to facilitate the pouring of concrete, and a pair of double hinge corner assemblies defining a total of four pivot points and being secured with opposite ends of said chamfered corner, and the double hinge corner assemblies also each being secured to an associated one of said panel sections, the panel sections being bodily movable with respect to the chamfered corners on the double hinge corner assemblies to effect release of the concrete form from the formed concrete wall structure.

16. The concrete form of claim 15 further characterized as having three sides joined by a pair of said chamfered corners for forming a concrete culvert or tunnel.

17. The concrete form of claim 15 further characterized as having four sides and as having a parallel sided shape with chamfered corners at all four corners of the form and with the sides being inwardly collapsible on said double hinge corner assemblies to effect release of the form from the formed concrete structure.

18. The concrete form of claim 15 further characterized by each double hinge corner having a pair of spaced hinges and hinge plate means between the hinges linking the hinges together, one hinge being secured to a margin of said chamfered corner, and another hinge being secured to an adjacent one of said panel sections permitting swinging action therebetween to effect release.

* * * * *